US008030228B2

(12) United States Patent
Flavin

(10) Patent No.: US 8,030,228 B2
(45) Date of Patent: Oct. 4, 2011

(54) COVER FOR CAMOUFLAGE AGAINST ELECTROMAGNETIC RADIATION

(75) Inventor: Edouard Flavin, Massy (FR)

(73) Assignee: MBDA France, Paris (FR)

( * ) Notice: Subject to any disclaimer, the term of this patent is extended or adjusted under 35 U.S.C. 154(b) by 0 days.

(21) Appl. No.: 12/441,338

(22) PCT Filed: Sep. 10, 2007

(86) PCT No.: PCT/FR2007/001455

§ 371 (c)(1),
(2), (4) Date: Mar. 13, 2009

(87) PCT Pub. No.: WO2008/031934

PCT Pub. Date: Mar. 20, 2008

(65) Prior Publication Data

US 2009/0317596 A1 Dec. 24, 2009

(30) Foreign Application Priority Data

Sep. 14, 2006 (FR) ..... 06 08040

(51) Int. Cl.
*B32B 3/00* (2006.01)

(52) U.S. Cl. ..... 442/132; 442/2; 442/21; 442/32; 442/38; 442/131; 442/133; 442/172; 442/179; 428/195.1; 428/209; 428/919; 342/3; 89/938; 2/900

(58) Field of Classification Search ..... 442/2, 21, 442/32, 38, 131, 132, 133, 172, 179; 428/919, 428/195.1, 209; 89/938; 342/3; 2/900
See application file for complete search history.

(56) References Cited

U.S. PATENT DOCUMENTS

| | | | | |
|---|---|---|---|---|
| 3,733,606 | A * | 5/1973 | Johansson | 342/3 |
| 4,479,994 | A | 10/1984 | Berg | |
| 4,659,602 | A | 4/1987 | Birch | |
| 5,881,409 | A * | 3/1999 | Pearce | 5/702 |
| 6,605,340 | B1 * | 8/2003 | Heiniger | 428/209 |
| 2006/0099431 | A1 | 5/2006 | Scholz | |
| 2006/0222827 | A1 * | 10/2006 | Marshall et al. | 428/195.1 |
| 2007/0281562 | A1 * | 12/2007 | Kohlman et al. | 442/32 |

FOREIGN PATENT DOCUMENTS

| | | |
|---|---|---|
| DE | 10 94 163 | 12/1960 |
| WO | 88/01363 | 2/1988 |
| WO | 2004/020931 | 3/2004 |

OTHER PUBLICATIONS

International Search Report dated Feb. 26, 2008 w/ English translation.
Written Opinion of the International Searching Authority with English translation.

* cited by examiner

*Primary Examiner* — Andrew T Piziali
(74) *Attorney, Agent, or Firm* — Dickinson Wright PLLC

(57) ABSTRACT

A cover for camouflage against electromagnetic radiation. According to the invention, the cover includes a random set of puckered features in relief, these being formed by a camouflage net associated with a flexible dielectric mesh.

20 Claims, 8 Drawing Sheets

COVER FOR CAMOUFLAGE AGAINST ELECTROMAGNETIC RADIATION

TECHNICAL FIELD OF THE INVENTION

The present invention relates to a blanket for electromagnetic camouflage of a piece of equipment against an observation device. Such a blanket is particularly suited to protect a piece of military equipment, for example stationary or moving vehicles, against detection by hostile forces. To this end, said blanket is applied up against the equipment to be protected.

BACKGROUND OF THE INVENTION

Such camouflage blankets are described, for example, in the documents U.S. Pat. No. 4,479,994, U.S. Pat. No. 4,659,602, WO 2004/020931 and WO 1988/01363.

These known camouflage blankets are generally effective against radar detection, but conversely they provide only very low protection against detection by an observation device operating in infrared radiation bands I, II and III.

To solve this problem, it is conceivable to provide, in said known camouflage blankets, a layer treated for infrared concealment, positioned on the side intended to be directed outward from the equipment to be protected. However, the effectiveness of such a layer treated for infrared concealment is very limited for infrared bands I and II when there is sun during the day. This is because, even if the emissivity of said layer is low, the layers behind end up radiating by progressively storing up heat.

In addition, in the case in which (as in the document U.S. Pat. No. 4,479,994) such a camouflage blanket comprises a plurality of superposed layers, at least one of which consists of a flexible panel of a radar absorber able to absorb microwave radar frequencies at least partly, experience has shown that such a layer treated for infrared concealment causes the performance of the radar absorber positioned behind to deteriorate. This phenomenon is probably due to the fact that the infrared treatment requires the use of low emissivity pigments which are at least partly electrically conductive. This protective layer must locally cause a abrupt variation in impedance which is detrimental to the functioning of the radar absorber. This problem is all the more marked, if a lower emissivity complex is desired.

SUMMARY OF THE INVENTION

The object of the present invention is to solve these problems and it relates to a multispectral camouflage blanket able to absorb microwave radar frequencies and to limit the thermal load in order to avoid infrared radiation in bands I, II and III, while providing camouflage in the visible region.

To this end, according to the invention, the electromagnetic camouflage blanket, comprising a flexible sheet, the inner surface of which is intended to face the side of a piece of equipment to be camouflaged and the outer surface of which is intended to face outward from said piece of equipment, is noteworthy in that said outer surface of said flexible sheet comprises a set of random folds that consist of a camouflage net associated with a flexible dielectric grid and which provide air pockets between said camouflage net and said flexible grid on the one hand and said outer surface on the other hand.

In the camouflage blanket according to the present invention, said camouflage net not only provides protection in the visible region through camouflage designs that it bears externally, but also has properties for ventilation between said folds and said outer surface. Such ventilation allows the blanket to remain at ambient temperature in order to limit thermal heating and hence infrared radiation.

The blanket according to the present invention therefore does not require the presence of a layer treated for infrared concealment and therefore eliminates the abovementioned problems with such a layer.

Said flexible grid is preferably joined to said camouflage net on the inner side of the latter. The grid may be based on any electrically conductive material, and more particularly based on carbon.

Said flexible sheet may be made of a polymer, such as polyvinyl chloride or suchlike, and its thickness is advantageously equal to 0.5 mm at most, preferably approximately equal to at least 0.3 mm.

The conductivity of said flexible grid, relative to a homogeneous layer, may be greater than and even far greater than 100 $\Omega^{-1}m^{-1}$, almost to the point of having a value close to a metal. In this case, the microwave frequencies are not absorbed by said folds, but are reflected in all directions. The energy returning in the direction of a detection radar is then greatly reduced by diffraction and/or scattering in other spatial directions.

However, the conductivity of said flexible grid, relative to a homogeneous layer, may be between 1 and 100 $\Omega^{-1}m^{-1}$. In this case the interactions of the electromagnetic wave are complex as this is an "intermediate" conductivity range. The three-dimensional structure of said grid gives rise to diffraction and, probably, scattering toward the highest frequencies and some absorption by successive reflections toward the lowest frequencies. Depending on the geometry of the equipment to be camouflaged, it may be advantageous for said inner surface of the flexible sheet to be metallized.

In a preferred embodiment of said camouflage blanket, this comprises, on the side of said inner surface of the flexible sheet, a wide-bandwidth radar absorber panel and said dielectric flexible grid has a complex permittivity of less than 100, and preferably less than 10.

A camouflage blanket is thus obtained with extremely high multispectral performance not only in the visible and infrared regions, but also in the microwave radar frequency region between 2 GHz and 100 GHz.

In this preferred embodiment, it will be noted:

- that said flexible sheet protects said radar absorber panel from bad weather; and
- that any risk of limiting the absorption performance of said radar absorber panel in the K and W bands (the absorption of frequencies in the C, X and K bands remaining effective) due to the presence of said flexible sheet is compensated for in the manner described above by the three-dimensional structure constituted by the raised folds formed by said flexible grid.

Furthermore, to avoid any risk of transmitting electromagnetic waves, said radar absorber panel may have a metallized film on its surface opposite said flexible sheet.

Advantageously, in this preferred embodiment of the present invention, said flexible sheet forms a flat protective cover in which said radar absorber panel is housed in a removable manner. Of course, such a protective cover plays a role in protecting said radar absorber panel.

To these ends of additional protection, said radar absorber panel is preferably confined in a sealed manner in a jacket, for example made of a polymer such as a polyethylene film or suchlike.

Due to the fact that said flexible sheet forms a protective cover in which said radar absorber panel is housed in a removable manner, it is possible to associate with said panel a plurality of different protective covers, the nets of which bear different camouflage designs, respectively suited to different environments. Hence, said radar absorber panel—which is the most expensive element of the camouflage blanket of the present invention—may be used with different protective covers, respectively suited to a particular environment.

Each protective cover may be provided with closing means, for example of the type with cooperating flexible hooks and loops.

In order to camouflage completely a piece of equipment with a large area, it is possible to juxtapose a plurality of blankets according to the present invention.

The figures of the appended drawing will allow a good understanding of how the invention may be embodied. In these figures identical references denote like elements.

DETAILED DESCRIPTION OF THE INVENTION

Figure 1:
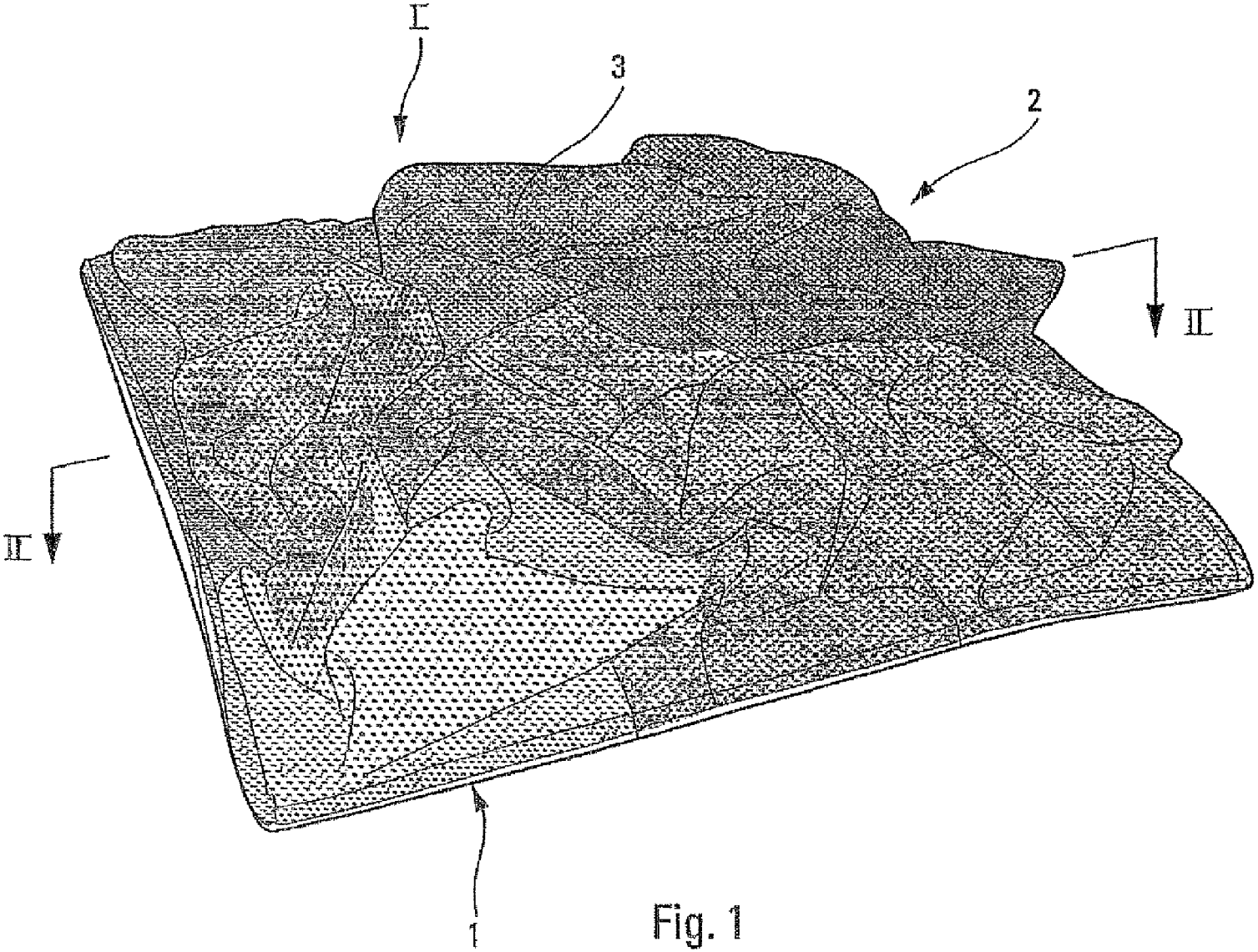
FIG. 1 is a schematic and partial perspective view of an embodiment of the camouflage blanket according to the present invention, said embodiment being viewed from above and from the outer side.
Figure 2:
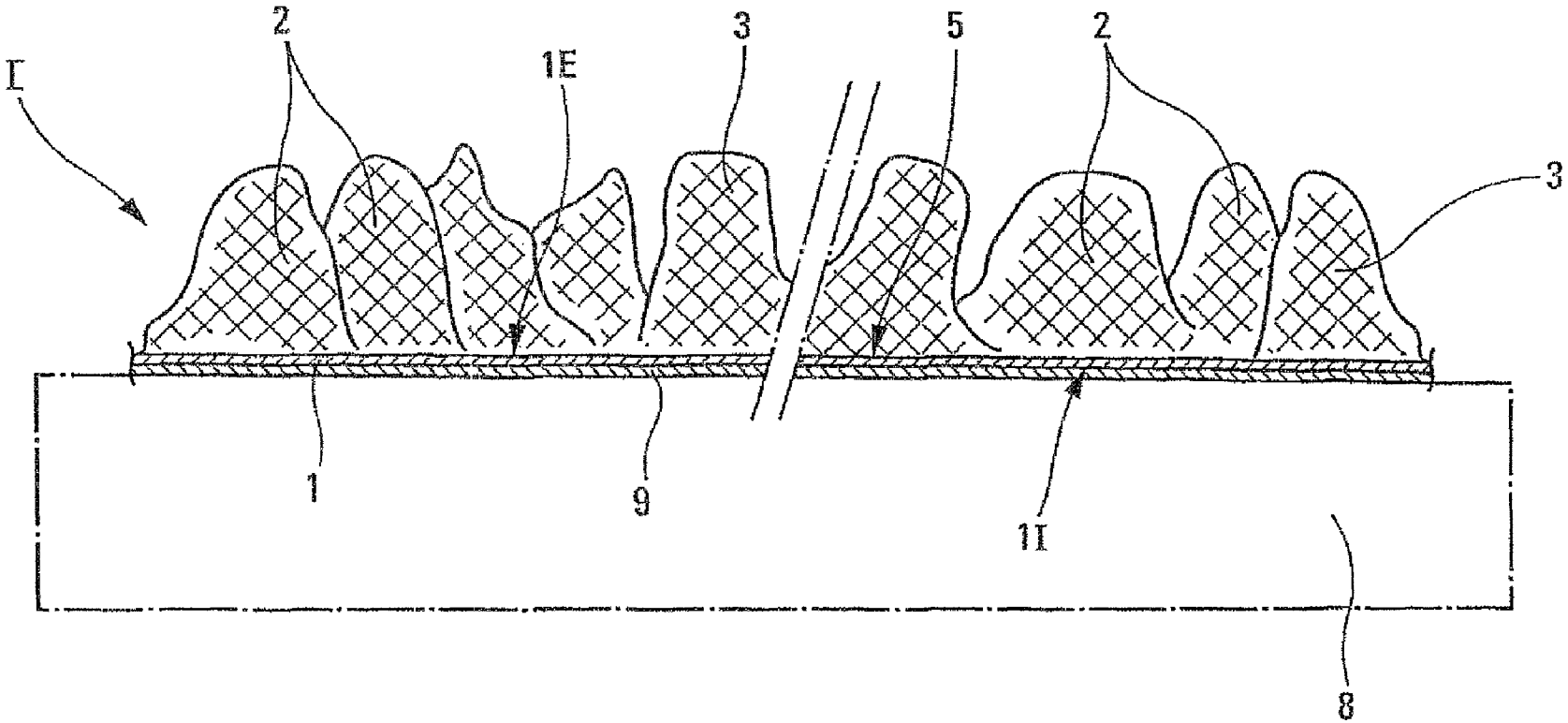
FIG. 2 is schematic cross section of the camouflage blanket of FIG. 1, along the line II-II thereof.

The camouflage blanket I according to the present invention and shown in FIGS. 1 and 2 comprises a sheet 1 made of a flexible material, for example a polymer such as a polyvinyl chloride, and having a thickness equal to 0.5 mm at most, preferably around 0.3 mm.

On its outer surface 1E, the sheet 1 has a set of random folds 2, consisting of a camouflage net 3 associated with a flexible dielectric grid 4, for example based on carbon fibers or particles. The folds 2 result, for example, from the fact that the camouflage net 3 and the grid 4 are sewn to the sheet 1 forming random projecting folds, providing air pockets with said outer surface 1E.

The grid 4 is preferably located on the inner side of the net 3, while the outer surface of the latter has camouflage designs (see FIG. 1), as is usual.

On its outer surface 1E, the sheet I may have a layer of paint or suchlike 5 in color harmony with said camouflage designs.

Figure 3:
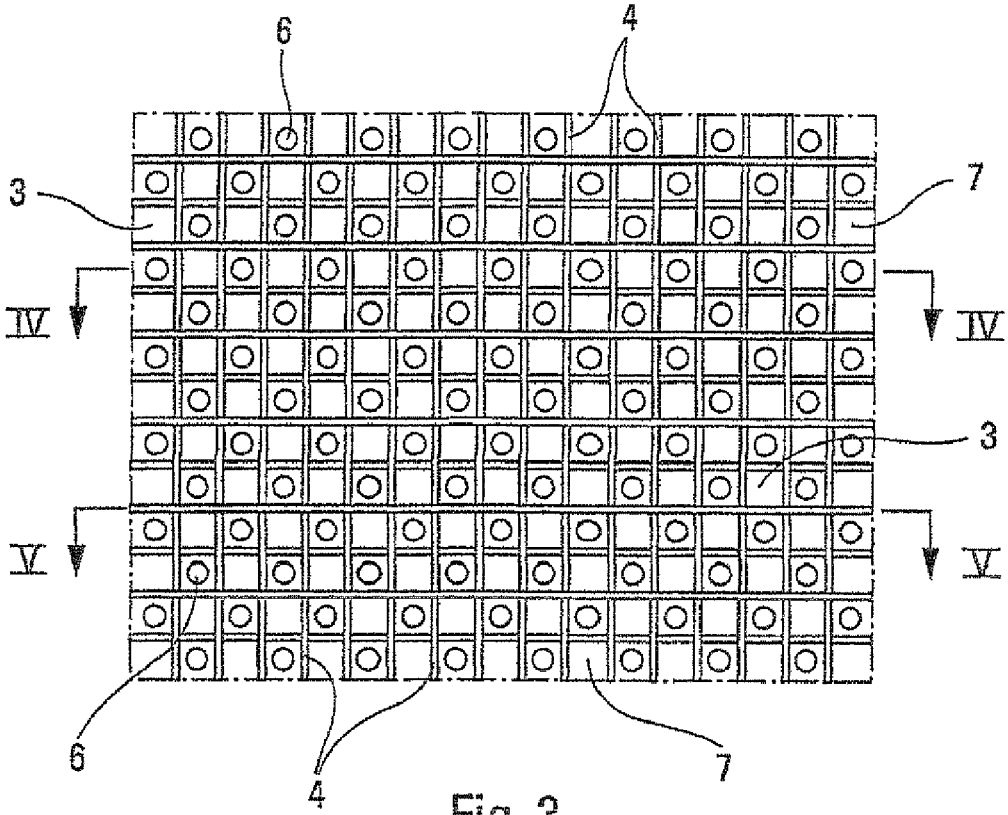
FIG. 3 is a schematic plan view of an embodiment of the camouflage net and of the electrically conductive grid borne by the outer surface of the blanket according to the invention and shown by FIGS. 1 and 2.
Figure 4:
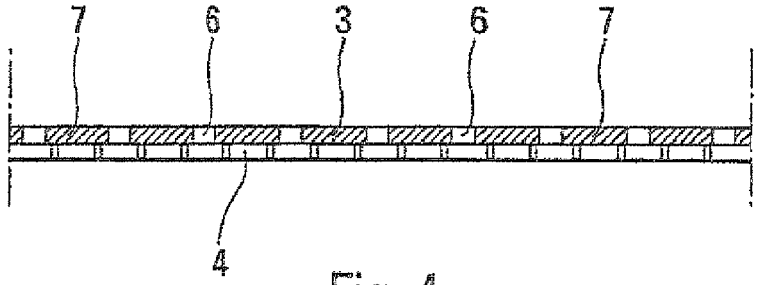
FIGS. 4 and 5 are schematic sections along the lines IV-IV and V-V of FIG. 3 respectively.
Figure 5:
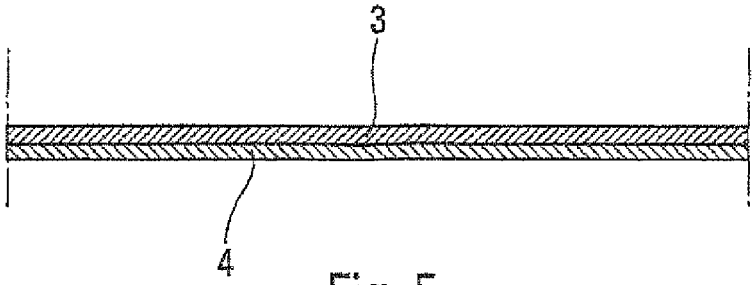
Figure 6:
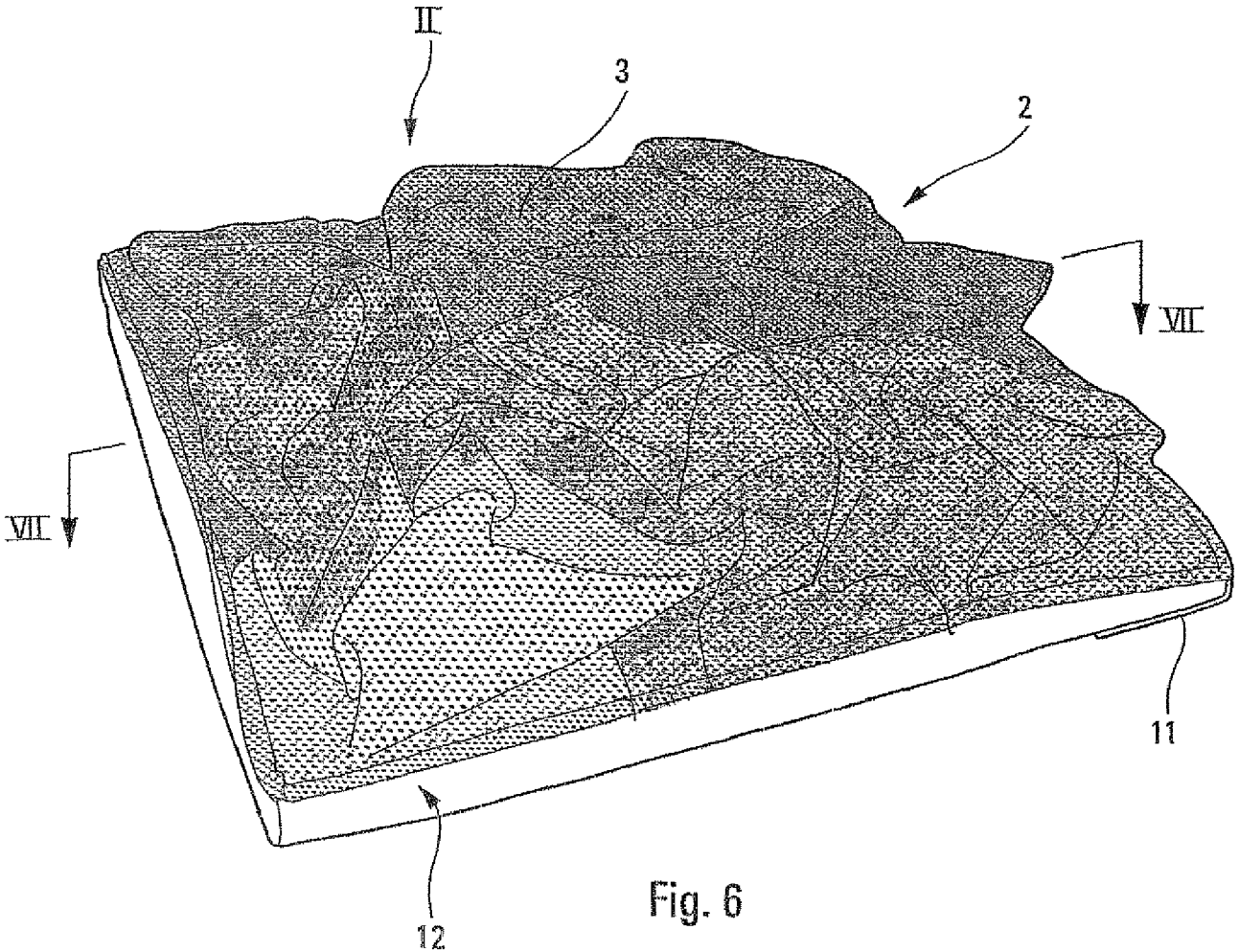
FIG. 6 is a schematic and partial perspective view of a variant of the camouflage blanket according to the present invention, viewed from above and from the outer side.
Figure 7:
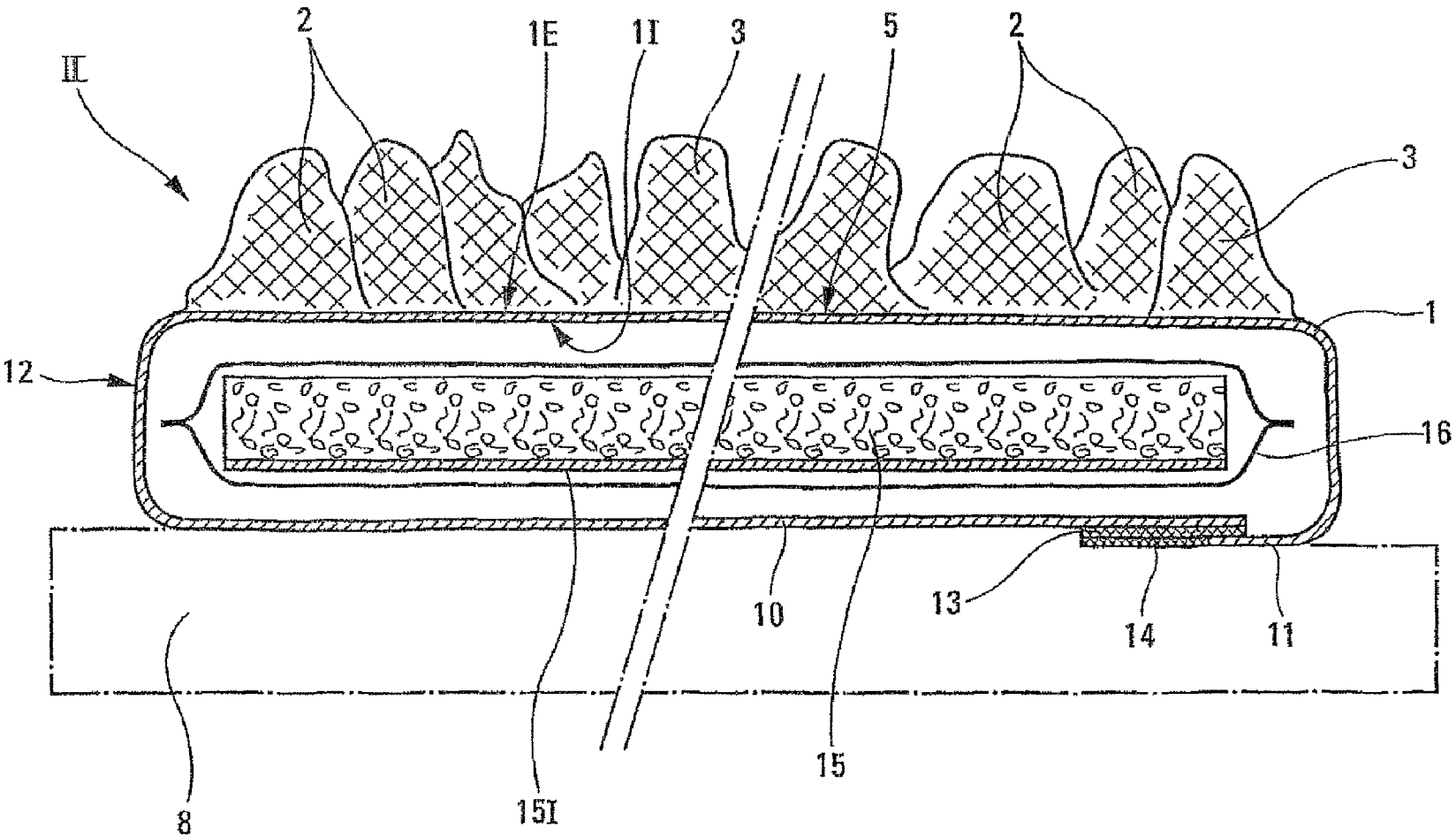
FIG. 7 is schematic cross section of the blanket of FIG. 6, along the line VII-VII thereof.

In the embodiment illustrated by FIGS. 3 to 5 a net 3 provided with openings or mesh cells 6 formed in a flexible support 7 has been shown. The conductive grid 4 may be joined to the inner surface of the net 3 by any known means.

Using any known, but not shown, means (straps, press-studs, hooks, etc.) the blanket I may be attached to a piece of equipment 8 (schematically represented by the dot-dash lines in FIG. 2) by the inner surface 11 of the sheet 1 in such a manner that the surface BE of the latter and the folds 2 face outward from said piece of equipment.

The inner surface II of the flexible sheet 1 optionally has a metallizing film 9 in contact with the piece of equipment 8.

As indicated above, the conductivity of the flexible grid 4 of the blanket I may be adjusted depending on the desired applications and on the optional presence of the metallizing film 9. This conductivity, relative to a homogeneous layer, may vary from 1 $\Omega^{-1}m^{-1}$ to 100 $\Omega^{-1}m^{-1}$, and even beyond 100 $\Omega^{-1}m^{-1}$.

In the embodiment II of the camouflage blanket according to the invention, shown by FIGS. 6 to 10, the elements 1 to 8 described above are again found, In this variant the flexible sheet 1 is extended by a long flap 10 on one side of the folds 2 and by another flap 11 on the other side, said flaps being designed to be applied up against the piece of equipment 8. The flexible sheet 1 also forms a flat protective cover 12 capable of being closed by the cooperation of the flaps 10 and 11. To this end, quick-fastening strips 13 and 14, for example of the flexible hook-and-loop type, respectively joined to the flaps 10 and 11, cooperate with each other to fasten said flaps to each other.

A radar-frequency absorber panel 15 may be positioned inside the protective cover 12, hermetically sealed in a flexible jacket 16, made for example of polyethylene film. The panel 15 may be of the type known by the commercial name AN74 available from Emerson and Cuming Microwave Products, Nijverheidsstraat 7A, 2260 Westerlo, Belgium. The inner surface 15I of the panel 15 is metallized.

In the camouflage blanket II, the flexible grid 4 of the folds 2 has a very low complex permittivity of less than 100, preferably less than 10.

Figure 8:
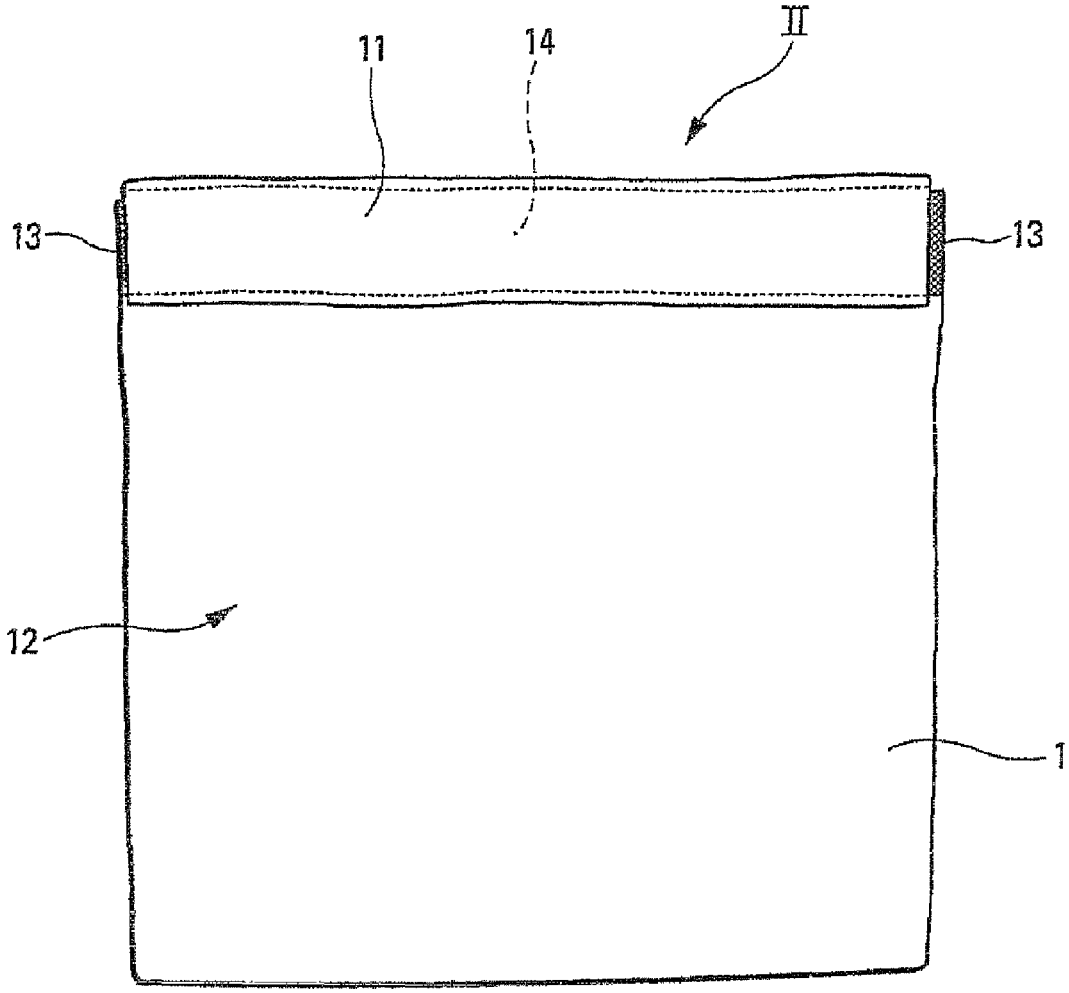
FIG. 8 is a schematic plan view, from the inner side, of the embodiment of FIGS. 6 and 7.
Figure 9:
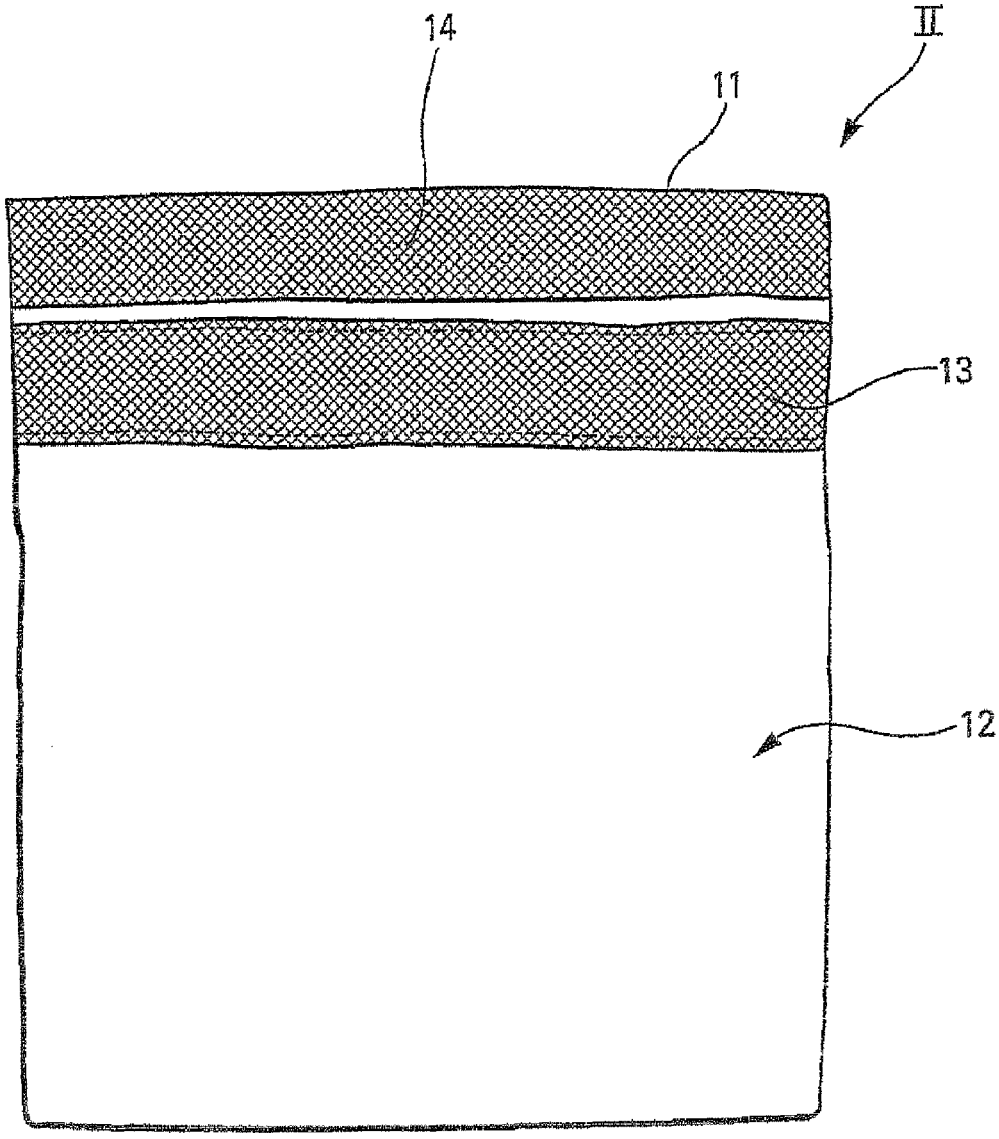
FIGS. 9 and 10 schematically illustrate the interchangeability of the protective cover of the blanket according to the present invention and shown by FIGS. 6 to 8.
Figure 10:
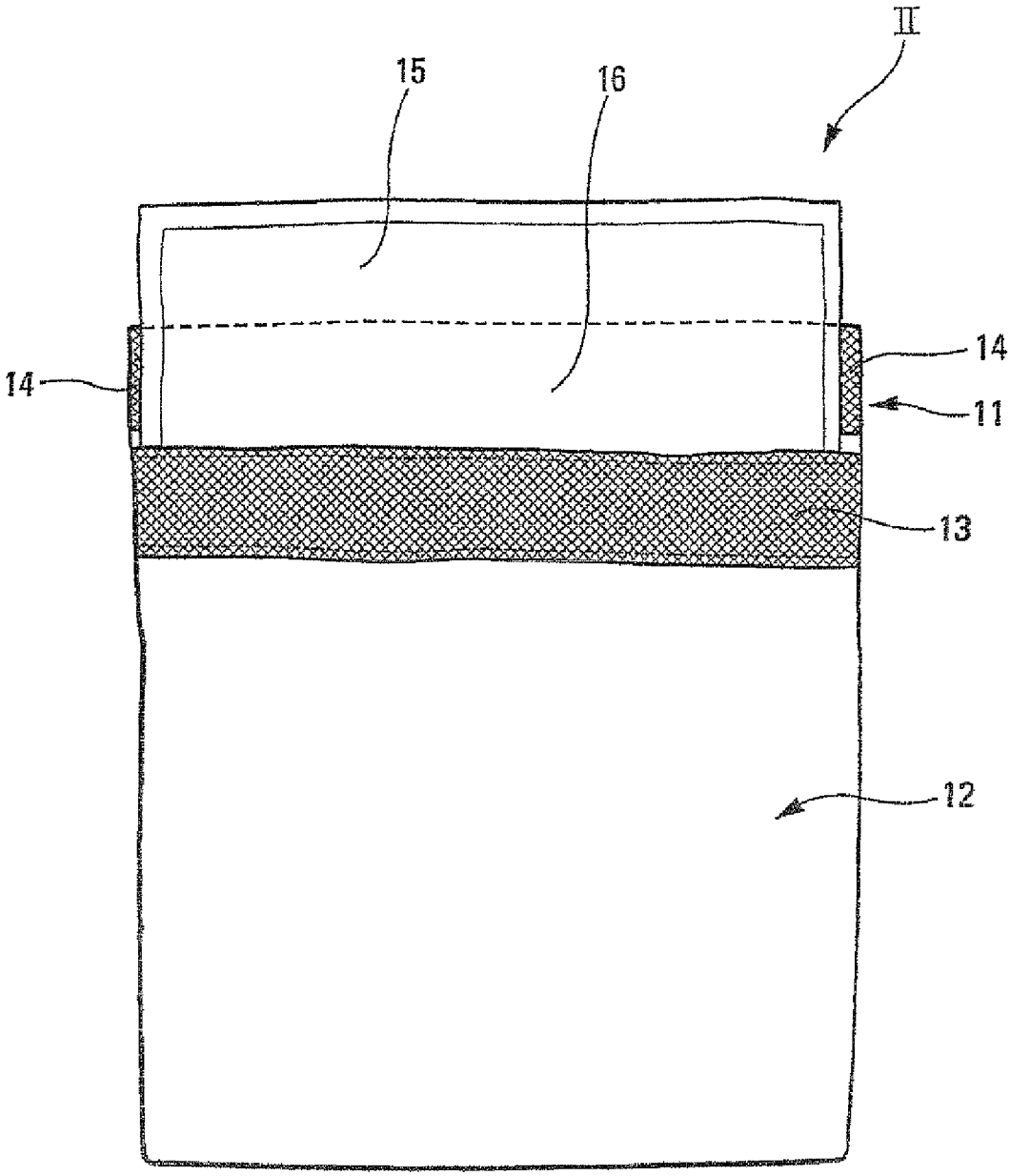

As illustrated in FIGS. 8 to 10, the protective cover 12 may be opened by separating the quick-fastening strips 13 and 14 and lifting the flap 11 (FIG. 9), after which the assembly of the panel 15 and its sealed jacket 16 may be removed from said protective cover (FIG. 10).

Thanks to this removability of the assembly of the panel 15 and the jacket 16, this may cooperate with several different protective covers 12 having camouflage nets 3 bearing different camouflage designs suited to different environments

The invention claimed is:

1. An electromagnetic camouflage blanket comprising a flexible sheet having an inner surface for facing at least a portion of equipment to be camouflaged and an outer surface for facing outward from said equipment;

a camouflage net; and a flexible electrically conductive grid that limits detection from microwave frequencies, wherein said camouflage net, in conjunction with said flexible electrically conductive grid, is attached to said flexible sheet to form random projecting folds that provide air pockets with said outer surface.

2. The blanket according to claim 1, wherein said flexible grid is joined to said camouflage net.

3. The blanket according to claim 1, wherein said flexible grid is located on the inner side of said camouflage net.

4. The blanket according to claim 1, wherein said flexible grid is based on carbon.

5. The blanket according to claim 1, wherein said flexible sheet is made of a polymer.

6. The blanket according to claim 5, wherein said flexible sheet has a thickness equal to or less than 0.3 mm.

7. The blanket according to claim 6, wherein the thickness of said flexible sheet is approximately equal to at least 0.3 mm.

8. The blanket according to claim 1, wherein said flexible grid has a conductivity greater than 100 $\Omega^{-1}m^{-1}$.

9. The blanket according to claim 1, wherein said flexible grid has a conductivity of between 1 $\Omega^{-1}m^{-1}$ and 100 $\Omega^{-1}m^{-1}$.

10. The blanket according to claim 9, wherein said inner surface of the flexible sheet has a metallized layer.

11. The blanket according to claim 1, further comprising, on a side of said inner surface of the flexible sheet, a wide-bandwidth radar absorber panel.

12. The blanket according to claim 11, wherein said flexible grid has a complex permittivity of less than 100.

13. The blanket according to claim 12, wherein said flexible grid has a complex permittivity of less than 10.

14. The blanket according to claim 11, wherein a surface of said radar absorber panel opposite said folds is metallized.

15. The blanket according to claim 11, wherein said flexible sheet forms a flat protective cover in which said radar absorber panel is housed in a removable manner.

16. The blanket according to claim 11, wherein said radar absorber panel is confined in a sealed jacket.

17. The blanket according to claim 16, wherein said sealed jacket is made of a polymer.

18. The blanket according to claim 11, wherein said removable radar absorber panel is associated with several flat protective covers having nets bearing different camouflage designs, respectively suited to different environments.

19. The blanket according to claim 15, wherein said protective cover is provided with a quick closure device.

20. Camouflage for a piece of equipment, comprising a plurality of blankets, according to claim 1, juxtaposed over said piece of equipment.

* * * * *